United States Patent [19]

Kohner et al.

[11] 4,136,875

[45] Jan. 30, 1979

[54] MULTI-GAME TOY MOUNTED ON TURNTABLE

[75] Inventors: Frank Kohner; Ralph Stern; Albert Stubbmann, all of Teaneck, N.J.

[73] Assignee: Wecolite Co., Inc., Teaneck, N.J.

[21] Appl. No.: 819,493

[22] Filed: Jul. 27, 1977

[51] Int. Cl.[2] ..... A63F 7/00

[52] U.S. Cl. ..... 273/121 R; 273/129 HA

[58] Field of Search ..... 273/110, 121 R, 121 A, 273/119 R, 119 A, 129 HA, 129 GA, 3 B

[56] References Cited

U.S. PATENT DOCUMENTS

| | | | |
|---|---|---|---|
| 414,986 | 11/1889 | Motter | 273/110 |
| 672,999 | 4/1901 | Burtis | 273/121 R |
| 895,786 | 8/1908 | Perkins | 273/3 B |
| 1,138,865 | 5/1915 | Hagerty | 273/119 R |
| 1,215,033 | 2/1917 | King | 273/110 |
| 2,530,187 | 11/1950 | Wolfe | 273/119 R |
| 3,297,325 | 1/1967 | Lerner et al. | 273/101 |
| 3,871,650 | 3/1975 | Casey | 273/123 R |

FOREIGN PATENT DOCUMENTS

| | | | |
|---|---|---|---|
| 82350 | 11/1956 | Denmark | 273/101 |
| 89395 | 5/1896 | Fed. Rep. of Germany | 273/119 R |
| 2448624 | 11/1974 | Fed. Rep. of Germany | 273/119 R |
| 767766 | 5/1934 | France | 273/110 |
| 1151of | 1902 | United Kingdom | 273/3 B |
| 405860 | 2/1934 | United Kingdom | 273/121 R |
| 1385655 | 2/1975 | United Kingdom | 273/119 R |

*Primary Examiner*—Paul E. Shapiro
*Assistant Examiner*—Lawrence E. Anderson
*Attorney, Agent, or Firm*—Kirschstein, Kirschstein, Ottinger & Cobrin

[57] ABSTRACT

A multi-game toy has a plurality of pinball-type games on a turnable disc which is mounted for turning movement on a housing. Each game has a set of balls, a playing field with designated scoring areas, and a movable firing pin on which the balls are respectively loaded. One of the games is selected and arrested in position at a predetermined game-playing location on the housing. A spring-actuated actuator is operative for propelling the firing pin to thereby launch the respectively loaded ball towards one of the scoring areas in order to play the selected game. A player looks through a magnifying lens which overlies the predetermined game-playing location in order to enlarge the view of the playing field of the selected game.

14 Claims, 6 Drawing Figures

FIG. 4
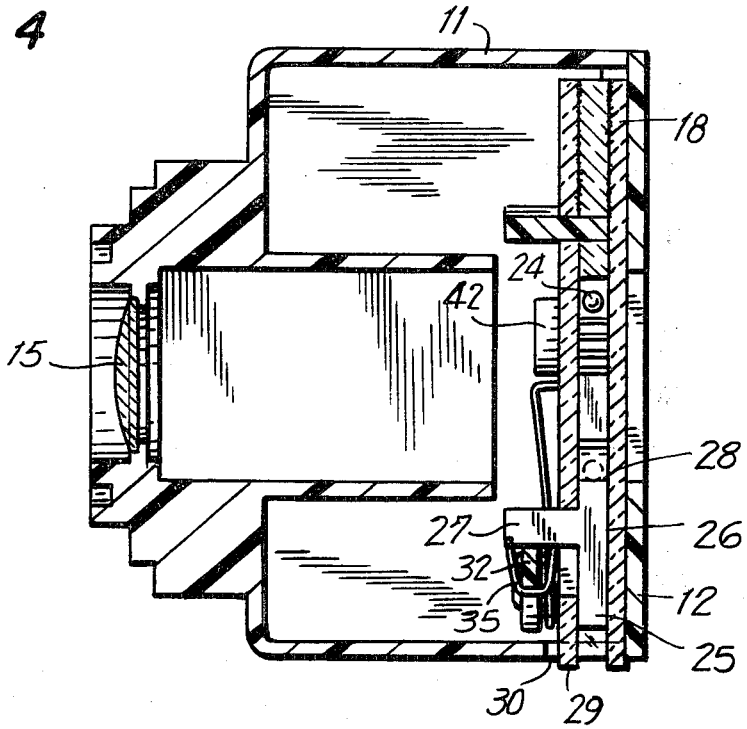
FIG. 5
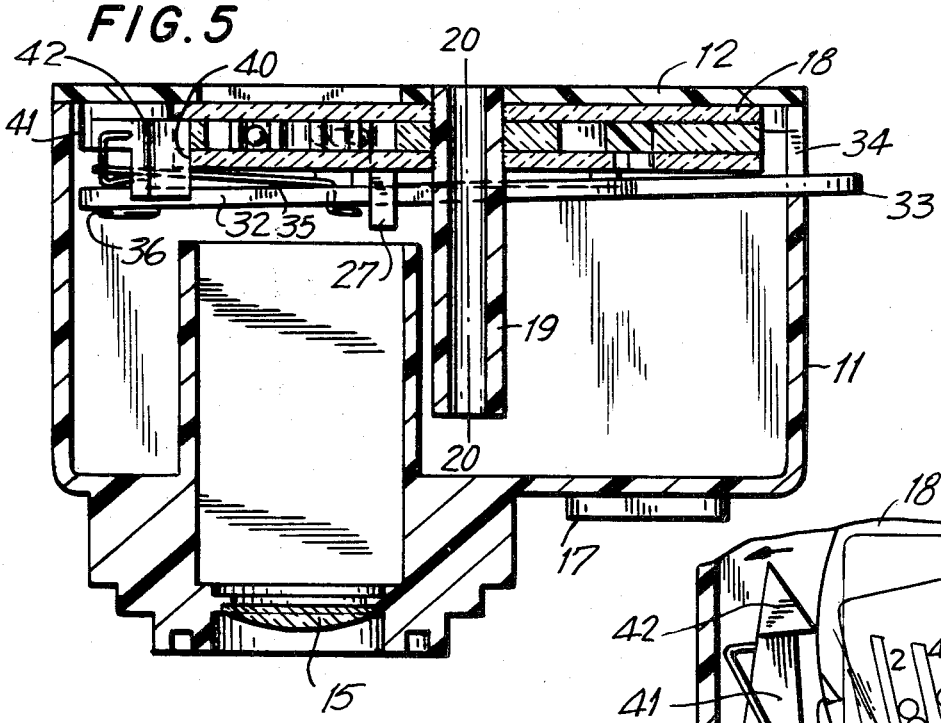
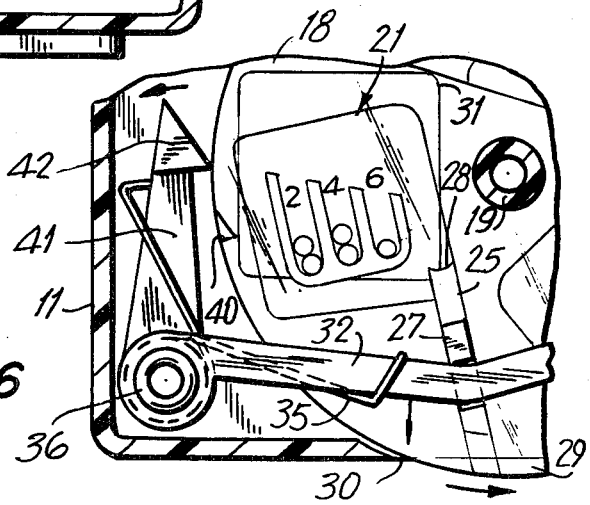
FIG. 6

MULTI-GAME TOY MOUNTED ON TURNTABLE

BACKGROUND OF THE INVENTION

1. Field of the Invention

The present invention relates generally to toys and, more particularly, to multi-game toys each game being of the pinball type.

2. Description of the Prior Art

Pinball-type games are well known in the toy art. Such games include a set of balls to be launched by a spring-actuated firing pin towards designated scoring areas on a playing field or gameboard. Such games are generally constructed of relatively large-sized dimensions so that a player can readily view the balls and the scoring areas without the aid of any external viewing devices.

One drawback currently prevalent in the prior art is that no adequate provision exists for a player to change from one pinball-type game to another. At present, one must loosely carry a plurality of games and thereupon substitute one for another. This is particularly undesirable in the case where the player is a small child, because, in this instance, the games are frequently misplaced. Moreover, the relatively large size of the individual games makes it very inconvenient for a player to carry a large number of such games from place to place.

SUMMARY OF THE INVENTION

Accordingly, it is the general object of the present invention to overcome the aforementioned drawbacks of the prior art.

An additional object of the present invention is to reduce the size of an individual game without sacrificing player visibility or convenience.

Still another object of the present invention is to permit a player to easily change from one game to another without misplacing any game during such substitution.

A further object of the present invention is to provide a novel multi-game toy which is easy to manufacture, long-lasting, and which provides entertainment reward for a player, particularly a child.

In keeping with these objects and others which will become apparent hereinafter, one feature of the invention resides, briefly stated, in a multi-game toy which comprises a housing having a predetermined game-playing location, and a turnable support or disc mounted on the housing for turning movement about an axis. A plurality of games are spaced about this axis on the disc. Each game has a toy element or ball to be displaced for playing the respective game. The games are movable with the turnable disc for registration of a selected one of the games at the predetermined location on the housing. Actuating means are provided at this predetermined game-playing location for displacing the ball of the selected game in order to play the same.

In accordance with the invention, the provision of a plurality of games on a turnable disc permits a player to easily change from one game to another simply by turning the disc to the requisite extent required to register a selected game at the predetermined game-playing location on the housing. No longer need a player fear the misplacement or loss of any individual game during such substitution.

In accordance with another feature of the invention, enlarging means, preferably a magnifying lens, is provided on the housing in juxtaposed overlying relationship with the selected game. A player merely looks through the lens in order to view the playing field and to chart the progress of the game. This feature permits miniaturization of each game, and thereby permits a large number of games to be provided on a single support disc in a minimum amount of space. The prior art drawback of requiring relatively large-sized games which occupy a great volume of space is thereby avoided.

In accordance with yet another feature of the invention, the actuating means comprises a single actuator member which is movable against the force of a spring. A player need only operate a single actuator to launch a ball in order to play the selected game. The same actuator is operative to displace balls of either the same game or of any other game which is subsequently registered at the game-playing location. In this manner a plurality of actuators is avoided with a concomitant savings of working space.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 4 is a sectional view of the toy taken on line 4—4 of FIG. 2;

FIG. 5 is a sectional view of the toy taken on line 5—5 of FIG. 2; and

FIG. 6 is a view analogous to FIG. 3, and shows the support offset from its position in FIG. 3.

DESCRIPTION OF THE PREFERRED EMBODIMENT

Figure 1:
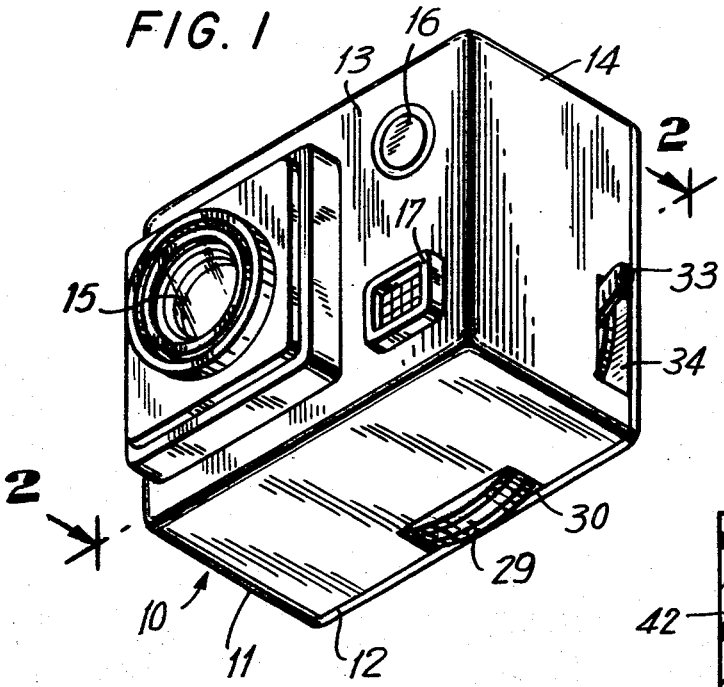
FIG. 1 is a perspective view of the multi-game toy in accordance with the present invention.

Reference numeral 10 in FIG. 1 generally identifies the multi-game toy of the present invention. The toy 10 includes a synthetic plastic material housing 11 having side walls 14 which bound an interior space. One end of the space is closed by a front wall 13 which is integral with the side walls 14. The other end of the space is covered by a rear wall 12 which is detachably mounted on the housing 11 preferably with snap-type action.

A magnifying lens 15, which will be described in greater detail below, is mounted on front wall 13, thereby making the overall appearance of the toy 10 resemble a box camera. A reflector element 16, such as a mirror, and a rectangularly-shaped projection 17 are both mounted on front wall 13, and both aid in creating this desired camera-like appearance for the toy.

Figure 2:
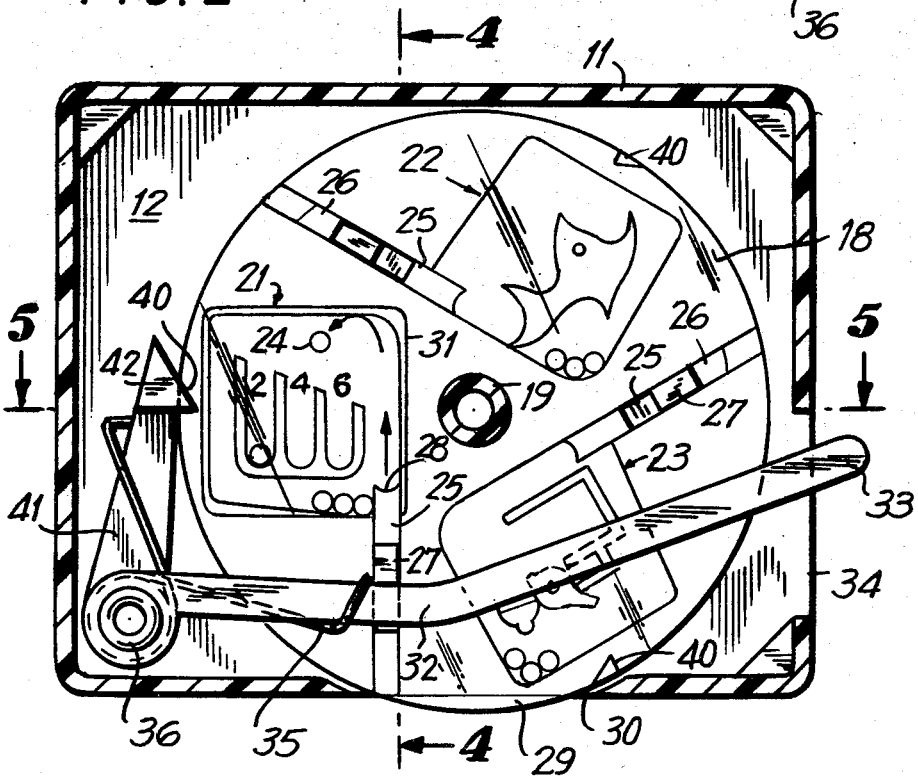
FIG. 2 is a top sectional view of the toy taken on line 2—2 of FIG. 1, and shows the actuator in one operative position.

FIG. 2 shows the interior of the toy 10. A turnable support or annular disc 18 is mounted on a shaft 19 which is, in turn, mounted on rear wall 12, as best shown in FIG. 5. Disc 18 is rotatable in either circumferential direction about axis of rotation 20.

A plurality of games 21, 22, 23 are spaced circumferentially about shaft 19 and equidistantly of each other on disc 18. Only three games are illustrated; however, it will be understood that any number and any type of games may be provided on disc 18. Each game has a playing field or gameboard with designated scoring areas, and at least one and preferably a plurality of toy elements or generally spherically-shaped balls 24 which are to be displaced towards the scoring areas for playing the respective game. For example, in pinball-type game 21, the numerals 2, 4, 6 on the playing field represent different scoring areas. A player will obtain a higher or lesser score in dependence upon which one of these areas receives the displaced ball 24. The object of the other games or puzzles 22, 23 is to receive each of the balls in a different area of the playing field. Other types of games are of course also possible.

Figure 3:
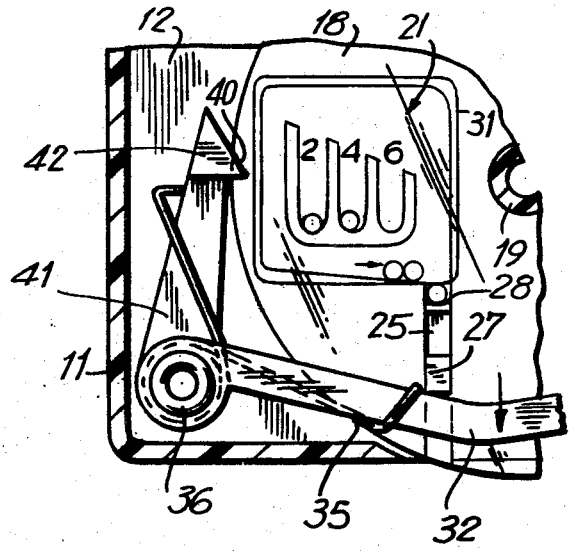
FIG. 3 is a top sectional view of the toy taken on line 2—2 of FIG. 1 and is analogous to FIG. 2, and shows the actuator in another operative position.

Each game has a launcher or firing pin 25 which is slidably mounted in a channel 26 formed in the disc 18. A nonillustrated spring may be located in channel 26 in order to properly urge the pin away from the playing area. Alternately, the pin is urged downwardly by gravity when the disc is so oriented that a given game is being played and the channel of the game is vertical. Each pin 25 is mounted for movement between a load position, as shown in FIG. 3, in which the ball 24 is loaded in the recess 28 on the leading end of pin 25, and a launch position, as shown in FIG. 2, in which the ball 24 is propelled away from pin 25 along the illustrated arrows towards one of the designated scoring areas on the playing field. The recess 28 provided at the leading end of each pin 25 has a part-spherical configuration in order to reliably receive a respective ball 24. Each pin 25 has a projection 27 which extends outwardly of the channel 26 in direction substantially normally of the disc 18, as best shown in FIG. 4.

A peripheral portion 29 of the disc 18 extends outwardly through access opening 30 of the housing 11. This peripheral portion 29 is thus accessible to a player so that one may manually turn the disc 18. Of course, motorized means may similarly be provided to turn disc 18. Since all of the games are mounted on the disc 18 and therefore move together with the same, any one of the games may be selected and registered at a predetermined game-playing location 31 on the housing 11. Location 31 is juxtaposed in overlying relationship with the magnifying lens 15 so that a player by viewing through the lens 15 may see the selected game in enlarged view.

In order to arrest the selected game at location 31, a plurality of notches 40 are equidistantly spaced about axis 20 at the periphery of disc 18. Each notch 40 corresponds to a respective game. A locking member 41 having a detent 42 is pivotally mounted on post 36. Biasing means or spring 35 is also mounted on post 36 and has two spring arms, one of which is wrapped around locking member 41 so as to urge detent 42 with a predetermined force into snapping engagement with the respective notch 40 which is associated with the selected game.

In order to play the selected game which has been registered and arrested in position at location 31, an actuator 32 is mounted on housing 11 for movement between a so-called cocked position, as shown in FIG. 3, in which the actuator 32 engages the projection 27 of firing pin 25 when the latter is in its load position, and a so-called go position in which the actuator 32 propels the firing pin 25 towards its launch position. A handle portion 33 of the actuator 32 extends outwardly through a port of the housing 11. A player now has access to the handle portion 33 and may manually move the actuator from its go operative position, as shown in FIG. 2, to its cocked position, as shown in FIG. 3. The other end of spring 35 is wrapped around actuator 32 and in cocked position has been flexed to store sufficient energy to propel the actuator 32 against projection 27 of firing pin 25 towards its launch position with a predetermined force when the handle portion 33 is released.

To briefly summarize the operation of the multi-game toy, a player selects a game and registers the same by manually turning disc 18 until the selected game appears through lens 15 at game-playing location 31. The firing pin descends in the channel 26 by gravity or by urging of a spring. A ball 24 descends by gravity onto the firing pin 25. The player next urges handle 33 against the force of the spring 35 for a desired distance and thereupon releases the handle 33. The spring 35 forcefully propels the firing pin and thereby the loaded ball 24 towards the designated scoring areas. If another game is to be selected, then the player again engages peripheral disc portion 29 and rotates the disc 18. As shown in FIG. 6, the detent 42 is disengaged from the respective notch 40. When the next notch 40 is indexed at location 31, then the force of spring 35 will urge the detent 42 towards the disc 18 and into snapping engagement with this new notch. As each game approaches its playable position, the associated projection will ride onto the actuator which at such time becomes operatively associated therewith.

It will be understood that each of the elements described above, or two or more together, may also find a useful application in other types of constructions differing from the types described above.

While the invention has been illustrated and described as embodied in a multi-game toy, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and described to be protected by Letters Patent is set forth in the appended claims:

1. A multi-game toy comprising:

(a) a housing having a predetermined game-playing location;

(b) a turnable support mounted on said housing for turning movement about an axis;

(c) a plurality of games each having a playing field of predetermined size and a toy element to be displaced for playing the respective game, said games being spaced about said axis on said support and being movable with the latter for registration of any selected one of said games at said predetermined location;

(d) actuating means at said predetermined game-playing location for displacing said toy element of the selected game to play the latter; and (e) means for enlarging the view of the playing field to a size larger than said predetermined size, said enlarging means including a magnifier lens mounted on said housing at a position remote from said predetermined location.

2. A multi-game toy comprising:

(a) a housing having a single predetermined game-playing location;

(b) a turnable support mounted on said housing for turning movement about an axis;

(c) a plurality of discrete games each having a playing field of predetermined size and a toy element to be displaced solely within the respective game for playing the latter, said games being spaced about said axis on said support and being movable with the latter for registration of any selected one of said games at said single predetermined location;

(d) actuating means for displacing respective toy elements, including a single actuator member common to all of said discrete games, said single common actuator member being located only at said single predetermined game-playing location and being movable relative to said support for displacing said toy element of the registered game to thereby play the latter; and (e) means on said housing for enlarging the view of the playing field to a size larger than said predetermined size.

3. A multi-game toy comprising:

(a) a housing having two openings and a predetermined game-playing location;

(b) a turnable support mounted on said housing for turning movement about an axis, said support having a portion which extends through one of said openings to permit manual turning of said support by a user;

(c) a plurality of games each having a playing field with designated scoring areas, a displaceable toy element, and a firing pin mounted on said support for sliding movement between a load position in which said toy element is loaded on said pin, and a launch position in which said toy element is propelled away from said pin towards said scoring areas, said games being spaced about said axis on said support and being movable with the latter for registration of a selected one of said games at said predetermined location;

(d) means for arresting any selected game at said predetermined location;

(e) actuating means at said predetermined game-playing location for displacing said firing pin to thereby propel said toy element, said actuating means including a movable actuator mounted on said housing for movement between a cocked position in which said actuator engages said firing pin in said load position, and a go position in which said actuator propels said firing pin towards said launch position, said actuator having a handle portion which extends through the other of said openings of said housing to permit manual movement of said actuator from said go position to said cocked position; and (f) means for enlarging the view of the playing field of the selected game at said predetermined game-playing location, including a magnifier lens mounted on said housing in juxtaposed overlying relationship with the selected game at said predetermined location and operative for magnifying the view of the playing field for a user viewing through said lens.

4. The toy of claim 1, wherein said lens is located at a position which overlies the selected game at said predetermined location.

5. The toy of claim 1, wherein said support is annular, and wherein said games are equidistantly spaced circumferentially of said annular support.

6. The toy of claim 1, wherein each game has a playing field with designated scoring areas, and additional toy elements similar to said first-mentioned toy element, all of said toy elements being displaceable by said actuating means towards said scoring areas.

7. The toy of claim 1, wherein said housing has an access opening, and wherein said support has a portion which extends through said access opening to permit manual turning of said support by a user.

8. The toy of claim 1; and further comprising means for arresting the selected game at said predetermined location, including a plurality of notches spaced about said axis on said support, each notch being associated with a respective game, and a locking member at said predetermined location and being mounted on said housing for movement between a non-locking position, and a locking position in which said locking member is received in the respective notch of the selected game at said predetermined location.

9. The toy of claim 8, wherein said arresting means includes biasing means for urging said locking member towards its locking position with a predetermined force.

10. The toy of claim 1, wherein each game has a firing pin slidably mounted on said support for movement between a load position in which said toy element is loaded on said pin and a launch position in which said toy element is propelled away from said pin.

11. The toy of claim 10, wherein said toy element is generally ball-shaped, and wherein said firing pin has a recess for receiving said ball-shaped toy element.

12. The toy of claim 10, wherein said actuator member is mounted on said housing for movement between a cocked position in which said actuator member engages said firing pin in said load position, and a go position in which said actuator member pushes said firing pin towards said launch position.

13. The toy of claim 12, wherein said housing has a port, and wherein said actuator member has a handle portion which extends through said port to permit manual movement of said actuator member from said go position to said cocked position.

14. The toy of claim 12, wherein said actuating means includes biasing means for pushing said firing pin towards its launch position with a predetermined force.

* * * * *